US011454453B2

(12) United States Patent
Kim

(10) Patent No.: US 11,454,453 B2
(45) Date of Patent: Sep. 27, 2022

(54) ROUND PLATE HEAT EXCHANGER

(71) Applicant: KYUNGDONG NAVIEN CO., LTD., Pyeongtaek-si (KR)

(72) Inventor: Young Mo Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 694 days.

(21) Appl. No.: 15/757,403

(22) PCT Filed: Sep. 1, 2016

(86) PCT No.: PCT/KR2016/009779
§ 371 (c)(1),
(2) Date: Mar. 5, 2018

(87) PCT Pub. No.: WO2017/052094
PCT Pub. Date: Mar. 30, 2017

(65) Prior Publication Data

US 2018/0245857 A1 Aug. 30, 2018

(30) Foreign Application Priority Data

Sep. 25, 2015 (KR) ..... 10-2015-0136673

(51) Int. Cl.
*F28D 9/00* (2006.01)
*F24H 1/34* (2022.01)
(Continued)

(52) U.S. Cl.
CPC ..... *F28D 9/0043* (2013.01); *F24H 1/34* (2013.01); *F24H 1/40* (2013.01); *F28D 21/0007* (2013.01);
(Continued)

(58) Field of Classification Search
CPC ..... F28D 9/0043; F28D 21/0007; F28D 2021/0035; F28D 2001/028; F28D 1/03;
(Continued)

(56) References Cited

U.S. PATENT DOCUMENTS 6,026,804 A * 2/2000 Schardt ..... F24H 1/40 126/344
2010/0300378 A1* 12/2010 Rigamonti ..... F24H 1/287 122/18.1

FOREIGN PATENT DOCUMENTS

CN 102395853 A 3/2012
EP 2420791 A2 2/2012
(Continued)

OTHER PUBLICATIONS

English translation of JP-2001-41678-A (Year: 2019).*
(Continued)

*Primary Examiner* — Henry T Crenshaw
(74) *Attorney, Agent, or Firm* — STIP Law Group, LLC

(57) ABSTRACT

The present invention discloses a round plate heat exchanger having a heat exchange part in which a plurality of heat medium flow paths and a plurality of combustion gas flow paths are formed alternately adjacent to each other between a plurality of plates. The plurality of plates are formed by stacking a plurality of unit plates comprising a first plate and a second plate stacked each therein. The plurality of heat medium flow paths are formed to be spaced from each other between the first plate and the second plate, a plurality of heat medium connection flow paths are formed in some areas of the plurality of heat medium flow paths, and each of the plurality of combustion gas flow paths is formed between the second plate of one unit plate and the first plate of another unit plate stacked adjacent to the unit plate.

14 Claims, 14 Drawing Sheets

(51) Int. Cl.

| | |
|---|---|
| ***F24H 1/40*** | (2022.01) |
| ***F28D 21/00*** | (2006.01) |
| ***F28F 3/04*** | (2006.01) |
| ***F28F 13/12*** | (2006.01) |

(52) U.S. Cl.
CPC ..... *F28F 3/042* (2013.01); *F28F 13/12* (2013.01); *F28D 2021/0035* (2013.01); *F28F 2265/10* (2013.01)

(58) Field of Classification Search
CPC ..... F28D 1/0308; F28D 1/0358; F28D 7/002; F28D 7/026; F28F 3/042; F28F 13/12; F28F 2265/10; F24H 1/34; F25F 1/00
USPC ..... 165/172
See application file for complete search history.

(56) References Cited

FOREIGN PATENT DOCUMENTS

| | | | | | |
|---|---|---|---|---|---|
| FR | 2855604 | A1 | * | 12/2004 | ..... F28F 9/005 |
| JP | H09196591 | A | | 7/1997 | |
| JP | 2000073878 | A | * | 3/2000 | ..... F28F 9/00 |
| JP | 2001041678 | A | * | 2/2001 | ..... F28F 3/04 |
| JP | 2001041678 | A | | 2/2001 | |
| JP | 2002048491 | A | | 2/2002 | |
| JP | 2003314976 | A | | 11/2003 | |
| JP | 2006342997 | A | | 12/2006 | |
| JP | 2006342997 | A | * | 12/2006 | |
| KR | 1020100056644 | A | | 5/2010 | |
| KR | 1020100088598 | A | | 8/2010 | |
| KR | 101086917 | A | | 10/2010 | |
| KR | 101400833 | B1 | | 5/2014 | |
| WO | WO9739301 | A1 | | 10/1997 | |
| WO | WO2015131758 | A1 | | 9/2015 | |

OTHER PUBLICATIONS

English translation of JP-2000073878-A (Year: 2021).*
English translation of FR2855604-A1 (Year: 2021).*
International Search Report of PCT/KR2016/009779, dated Nov. 23, 2016, English translation.

* cited by examiner

【FIG. 1】
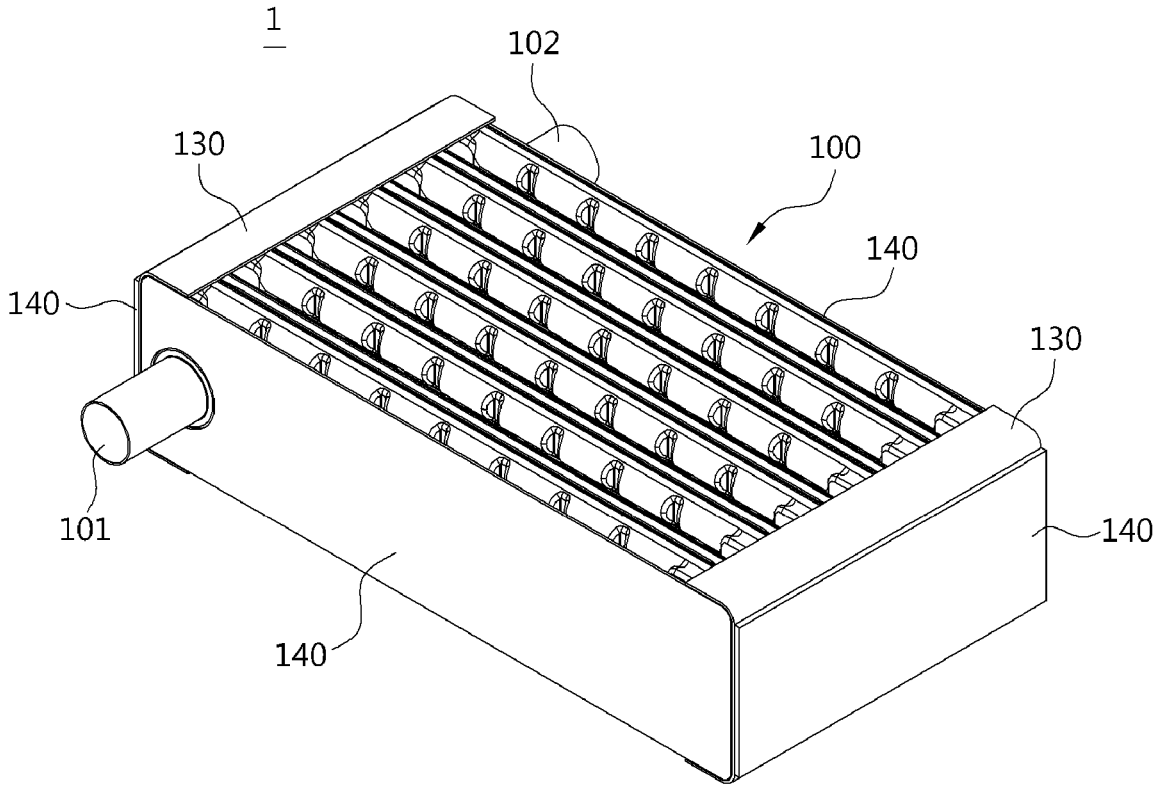

【FIG. 2】
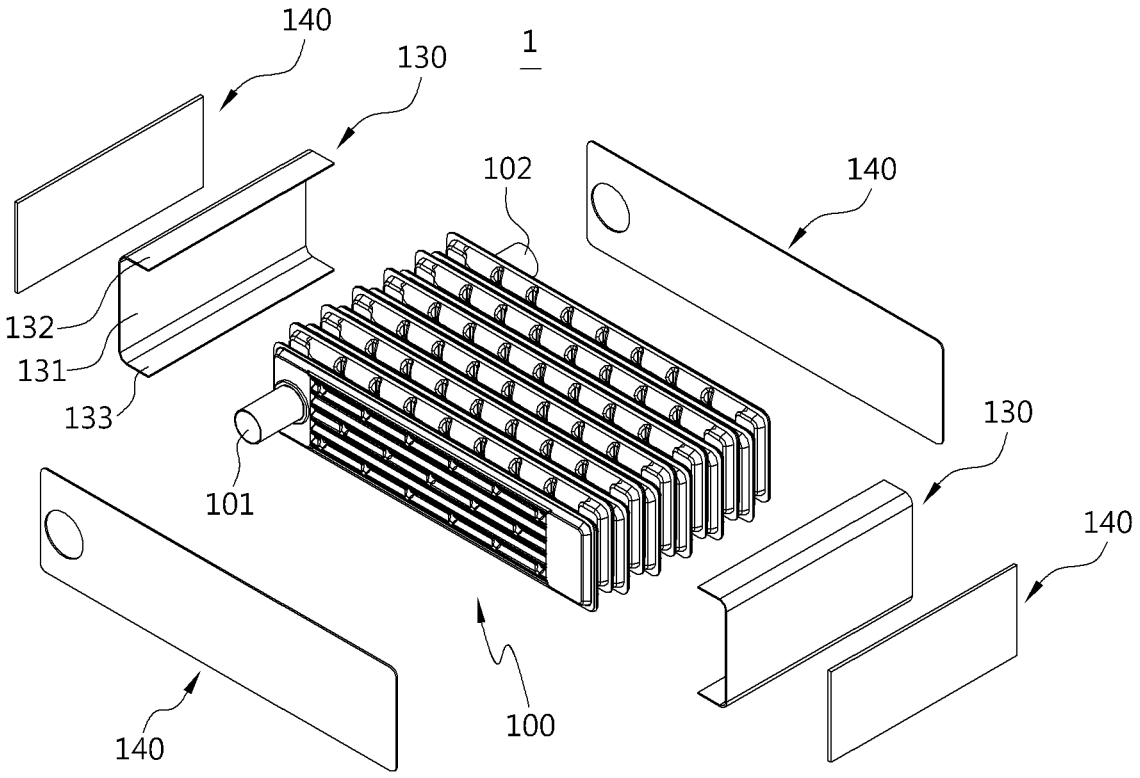

【FIG. 3】
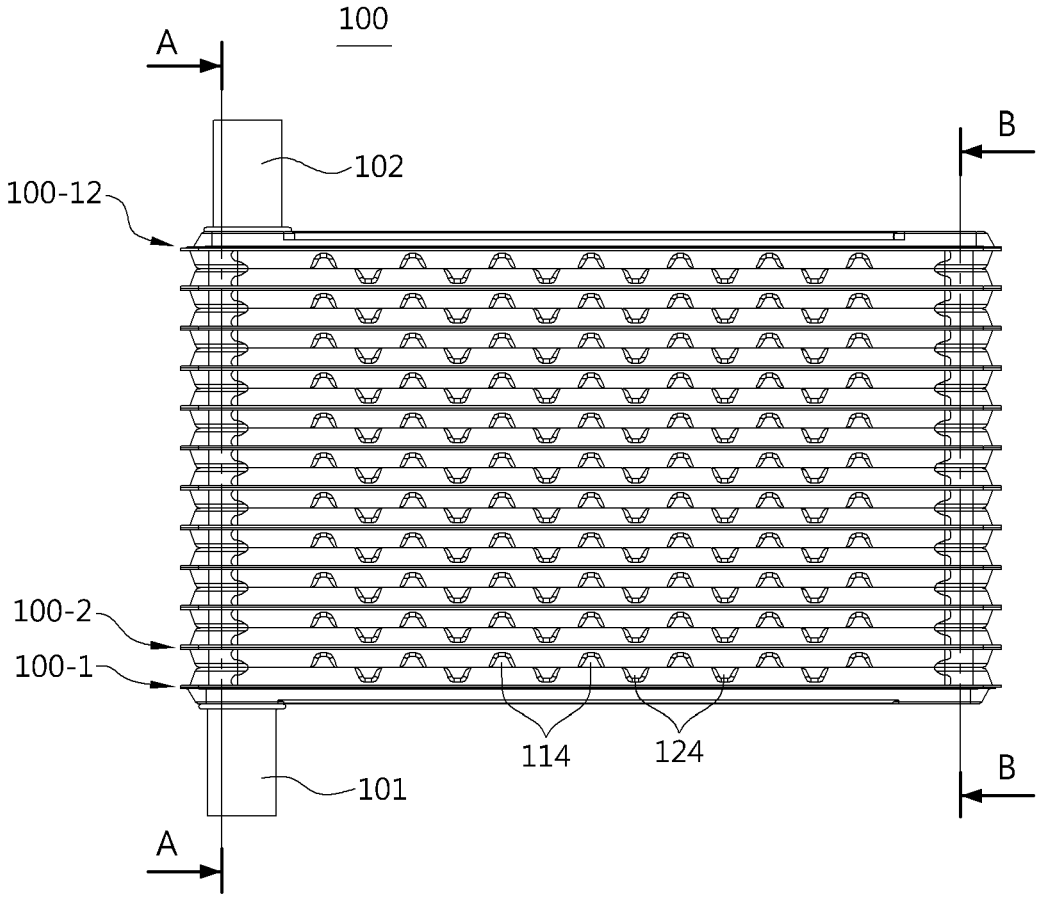

【FIG. 4】
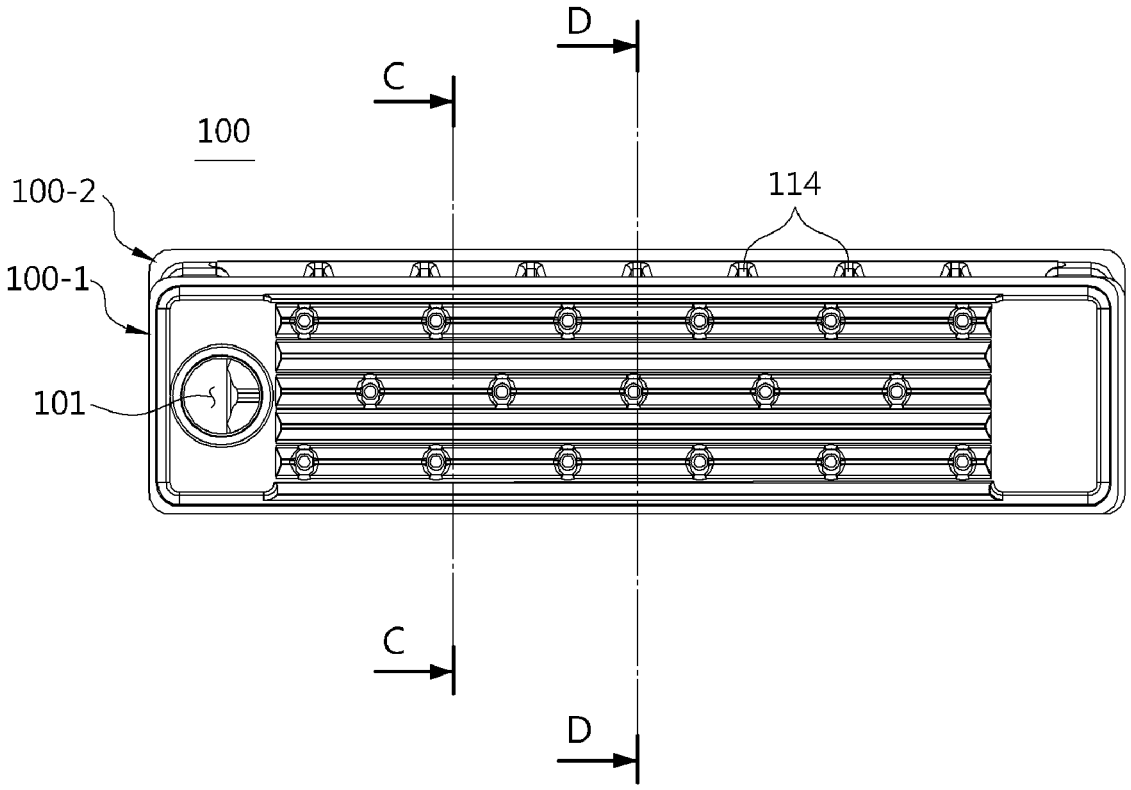

【FIG. 5】
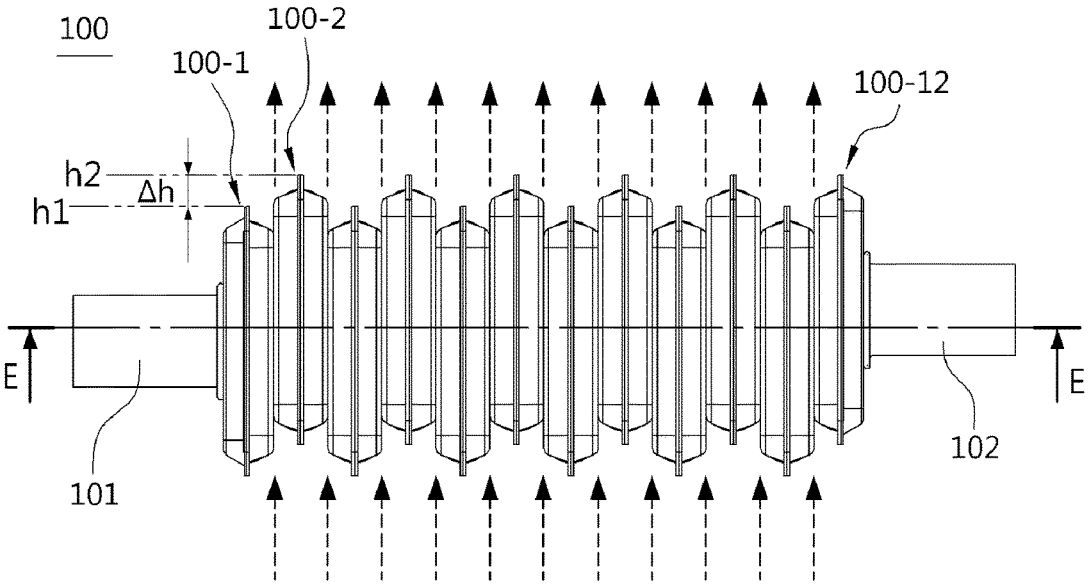
5

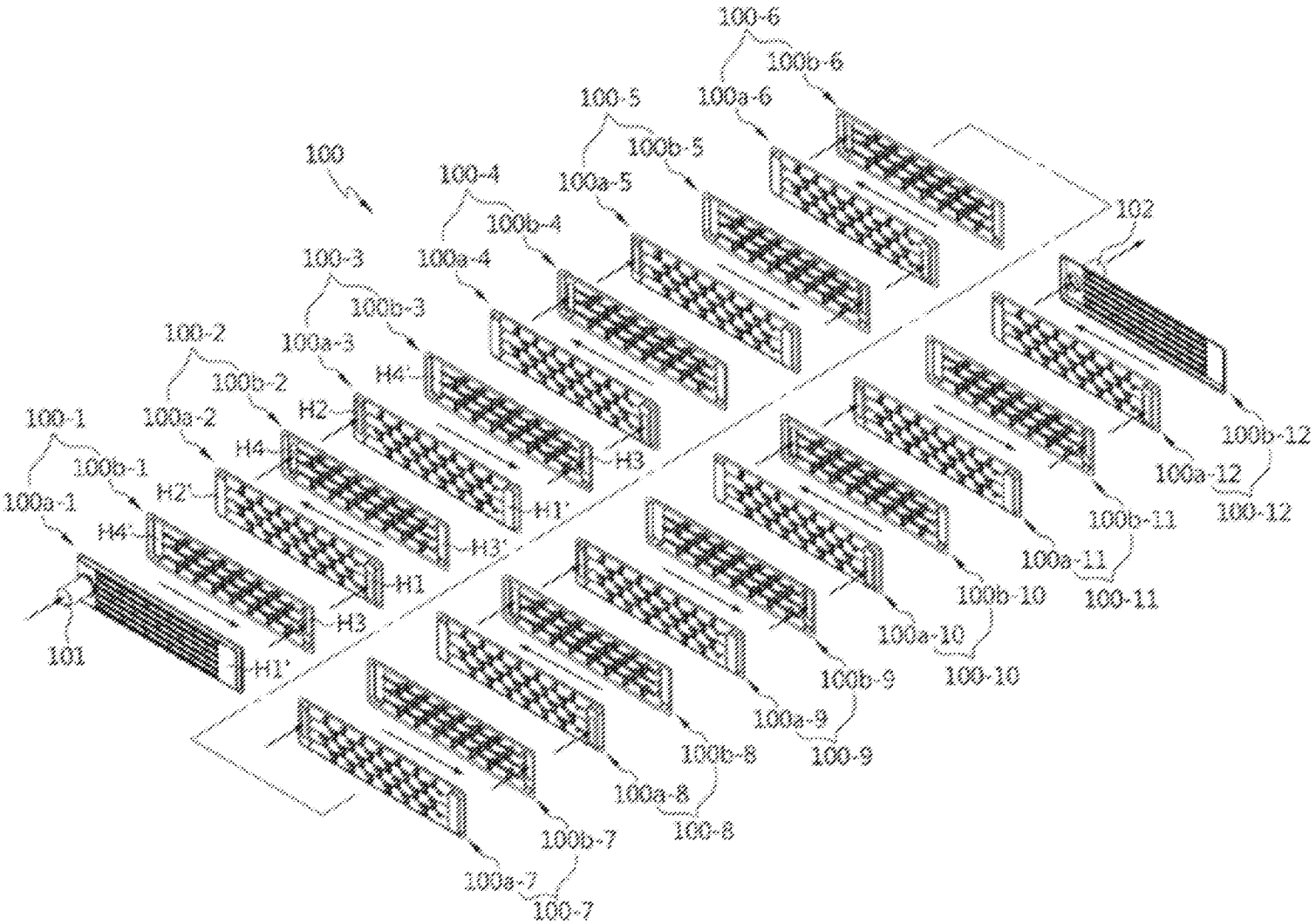
[FIG. 6]

【FIG. 7】
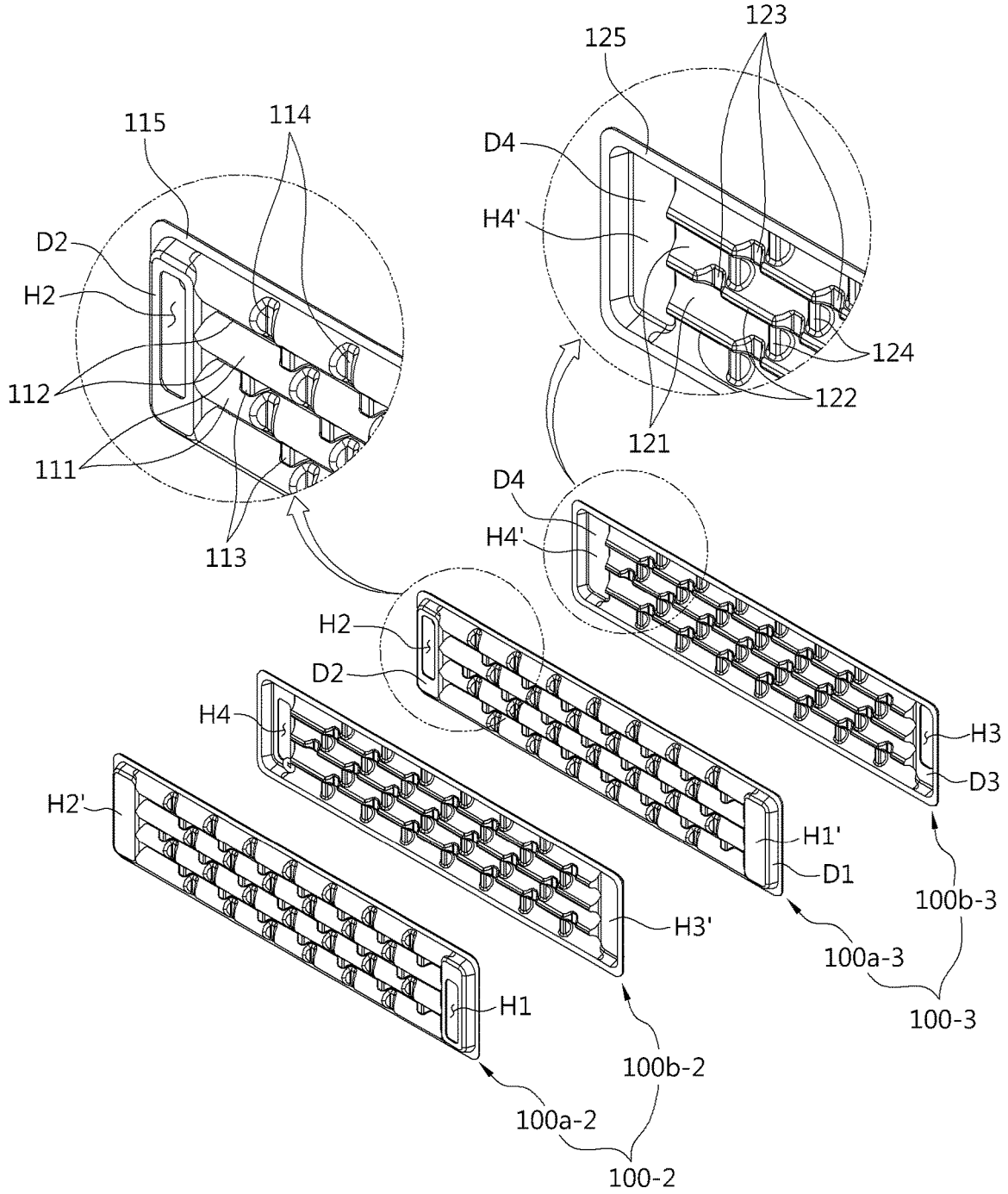

【FIG. 8】
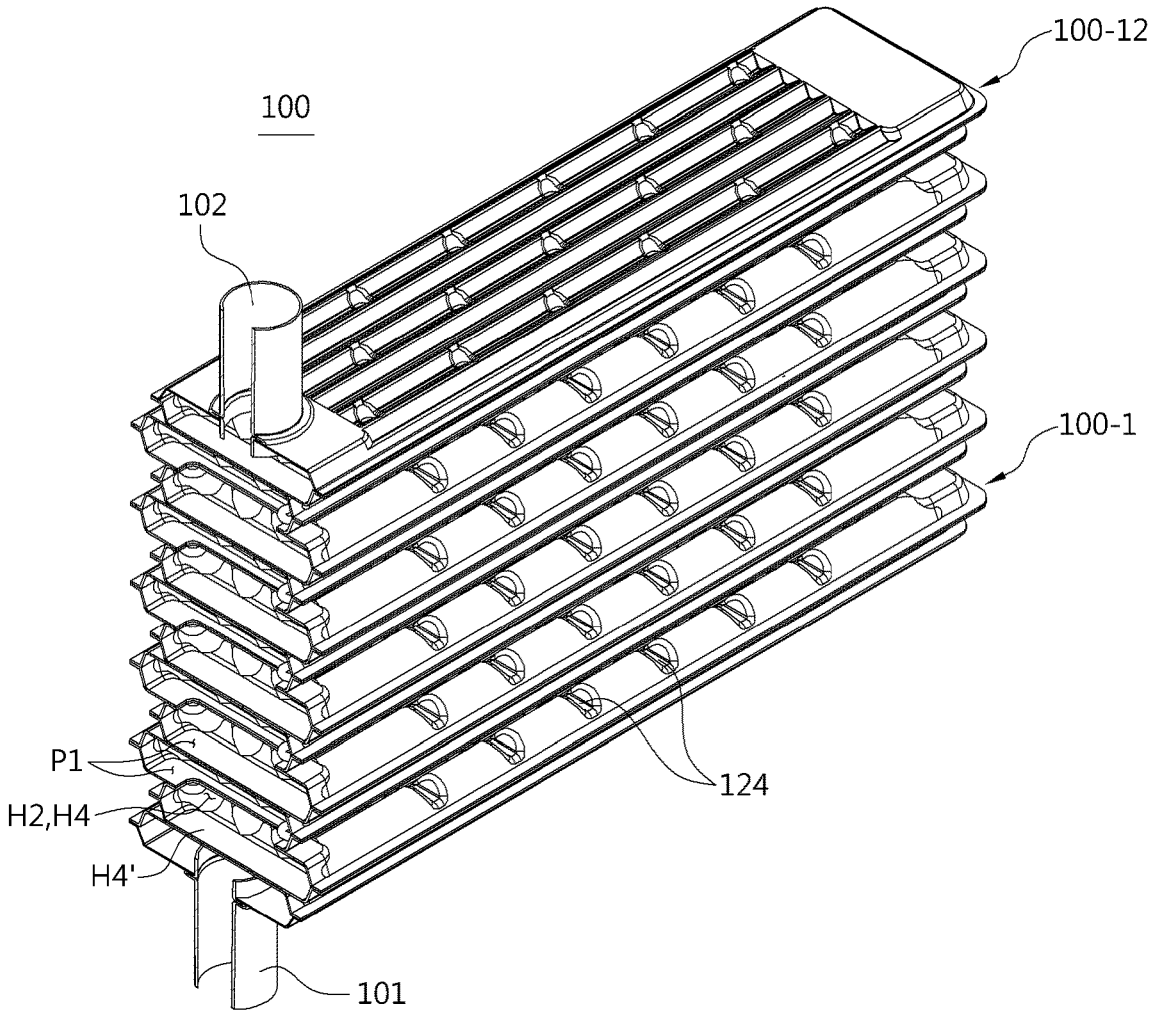

【FIG. 9】
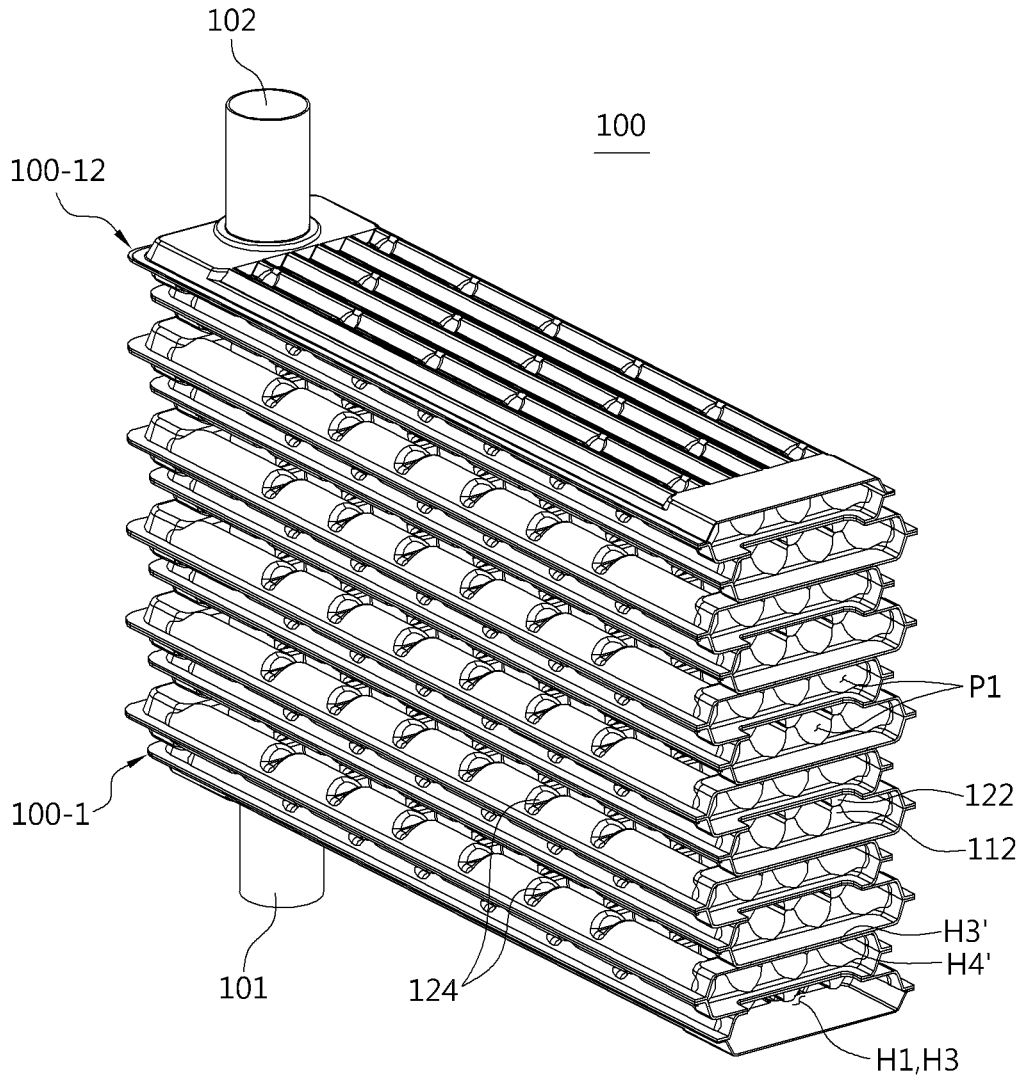

【FIG. 10】
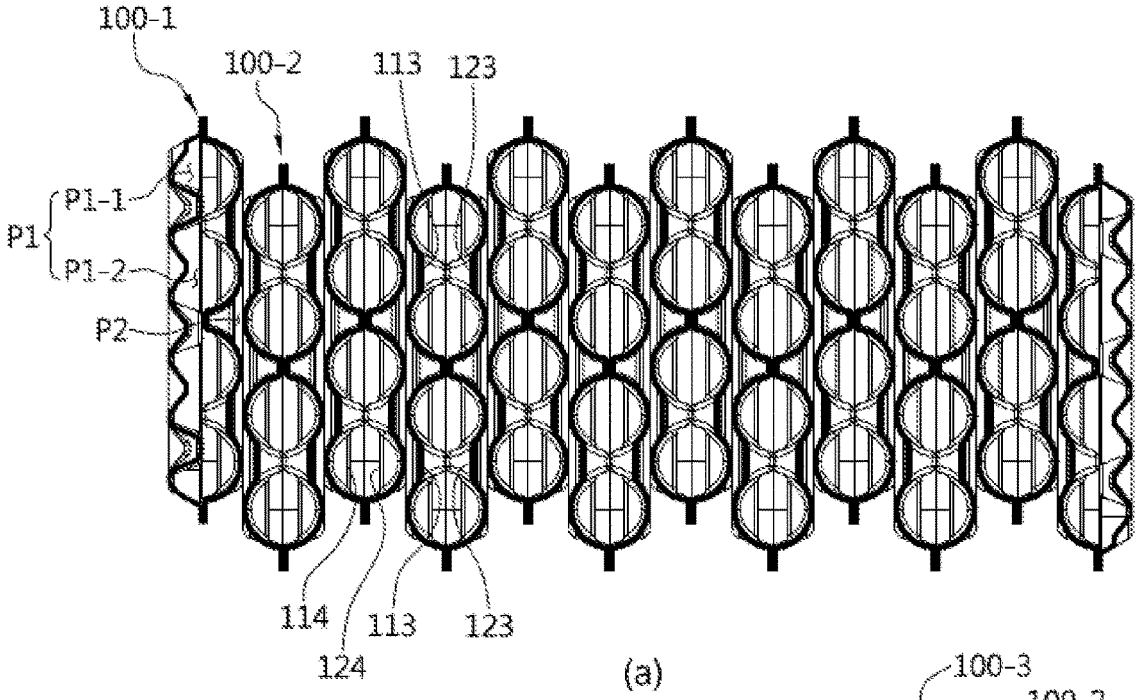
(a)
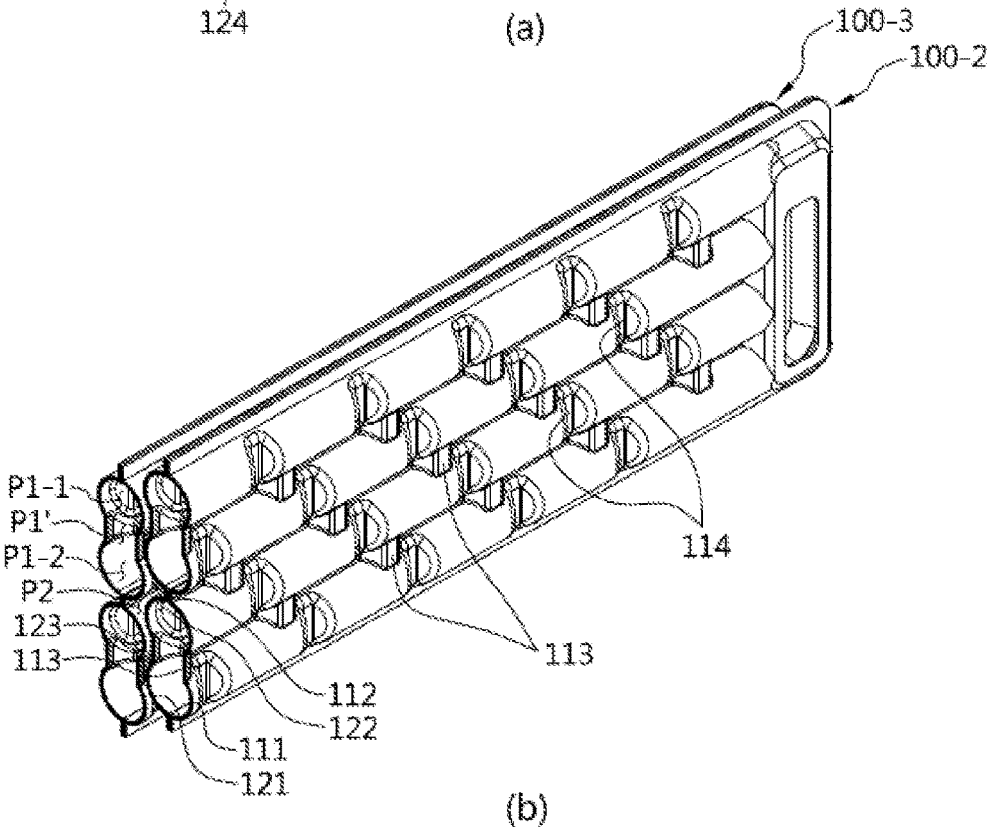
(b)

【FIG. 11】
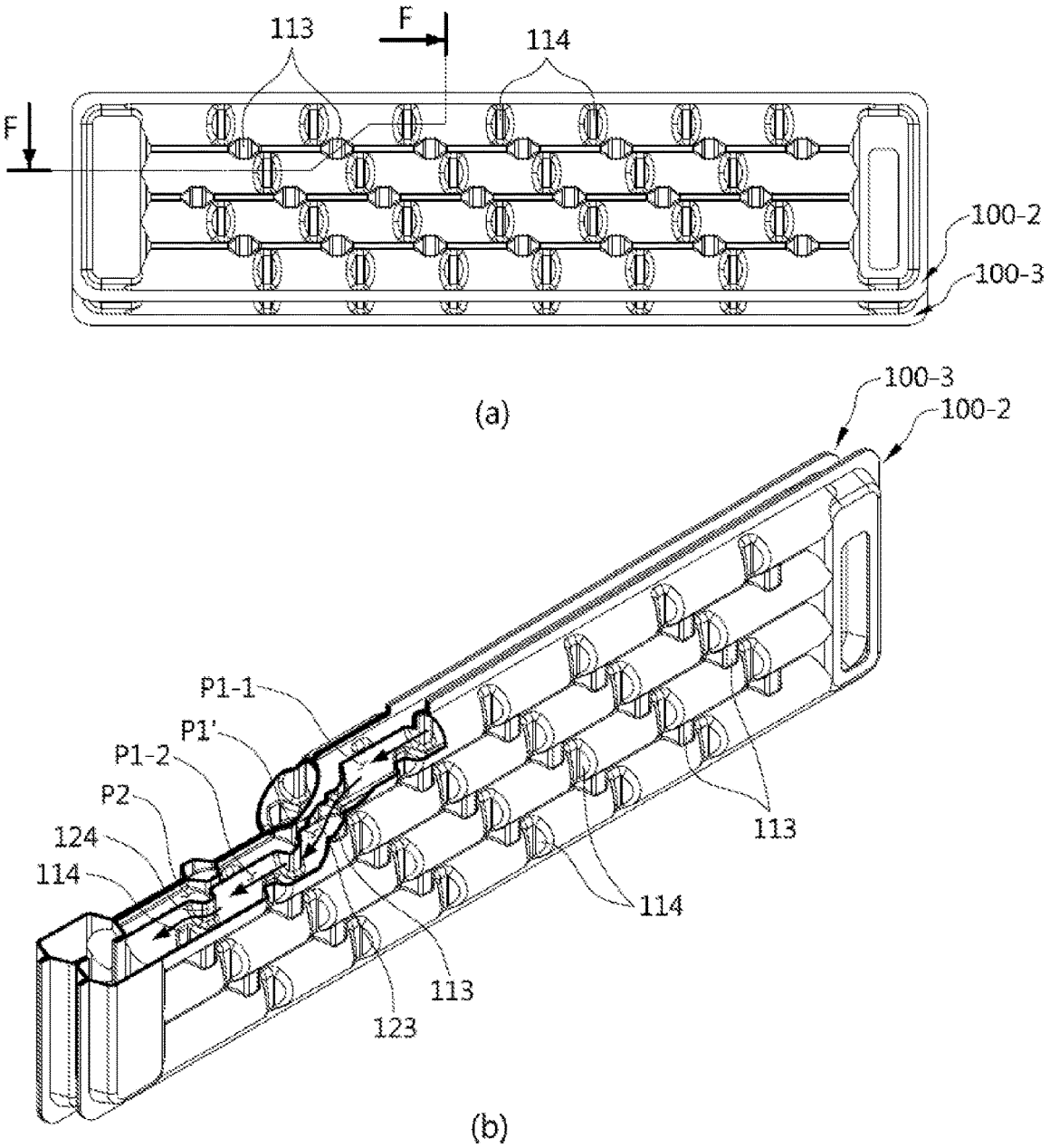

【FIG. 12】
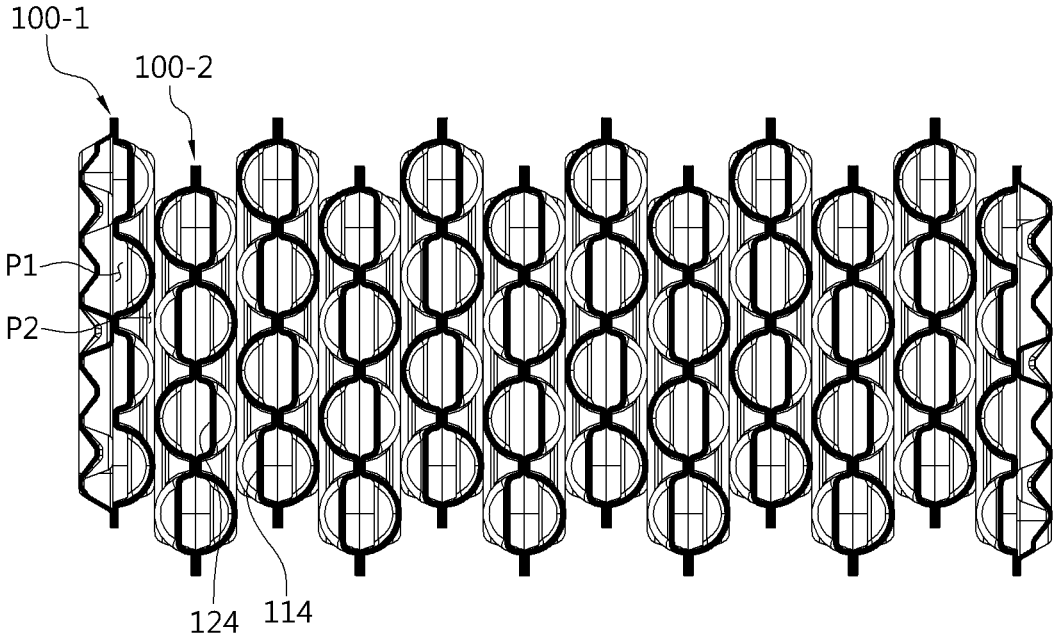
(a)
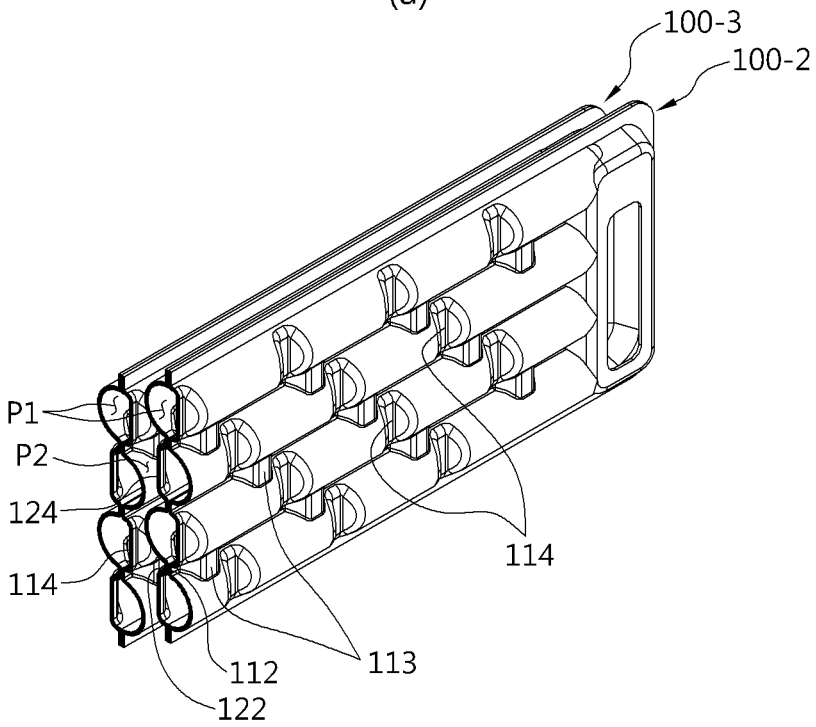
(b)

【FIG. 13】
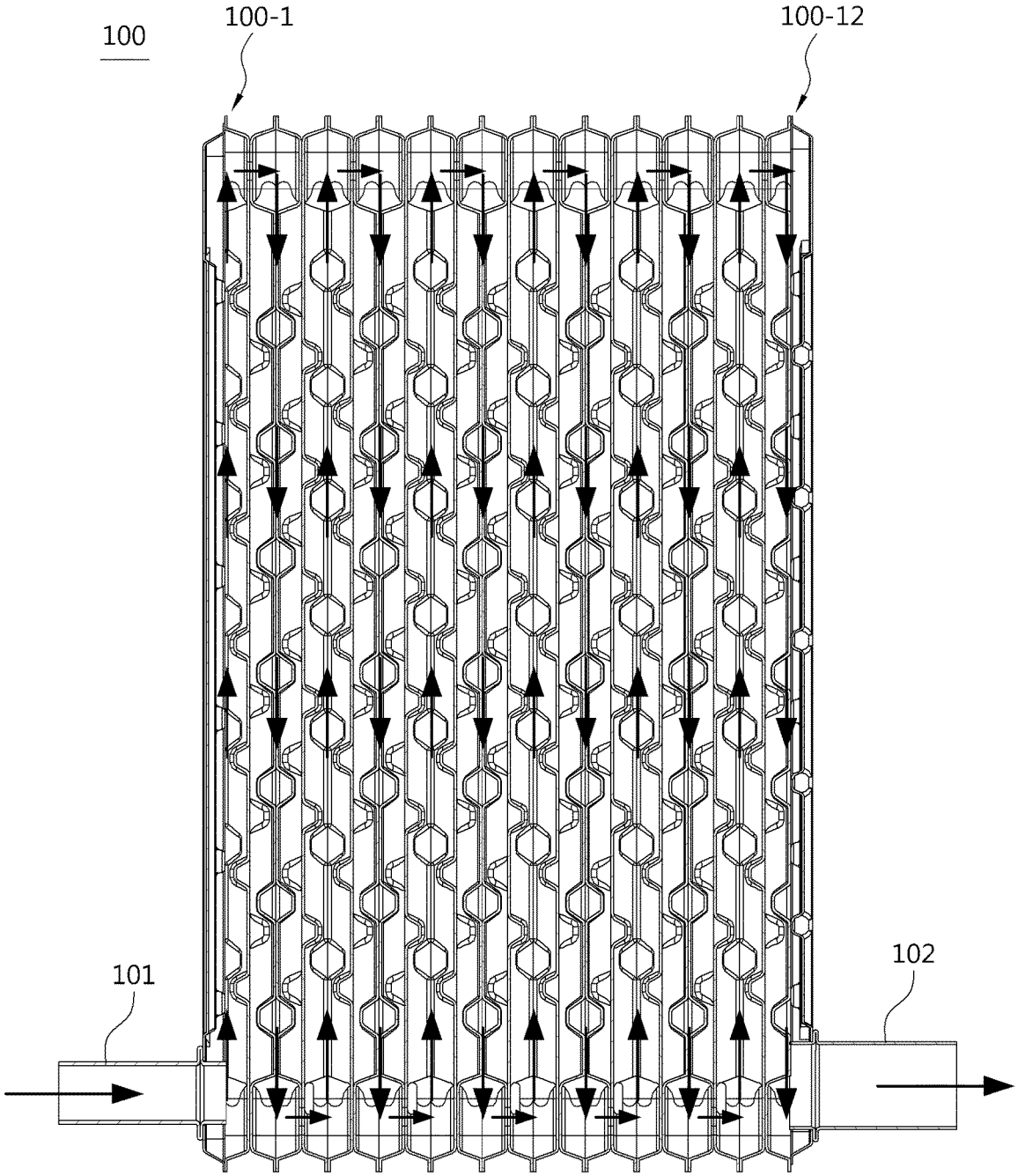

【FIG. 14】
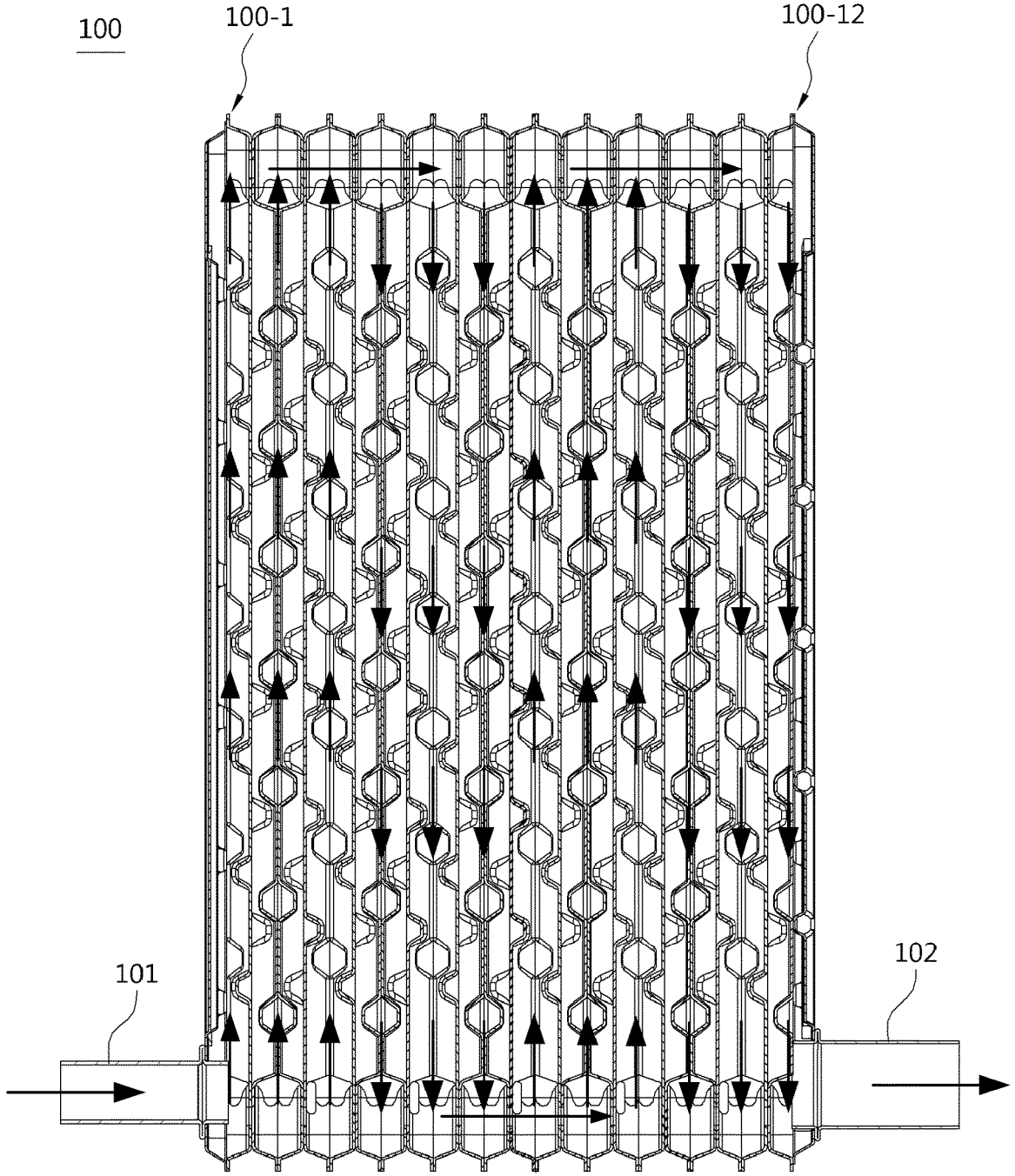

ROUND PLATE HEAT EXCHANGER

CROSS-REFERENCE TO RELATED APPLICATIONS

This application is the U.S. National Phase under 35 U.S.C. § 371 of International Application No. PCT/KR2016/009779 filed on Sep. 1, 2016, which in turn claims the benefit of Korean Application No. 10-2015-0136673, filed on Sep. 25, 2015, the disclosures of which are incorporated by reference into the present application.

TECHNICAL FIELD

The present invention relates to a round plate heat exchanger, and more particularly, to a round plate heat exchanger having a long flow path of a heat medium formed in an inner space between a plurality of stacked plates and promoting generation of turbulence in flows of the heat medium and a combustion gas to improve heat exchange efficiency.

BACKGROUND ART

Generally, a heating device includes a heat exchanger in which heat exchange is performed between a heat medium and a combustion gas through combustion of a fuel and performs heating or supplies hot water using a heated heat medium.

A fin-tube type heat exchanger among conventional heat exchangers is configured such that a plurality of heat transfer fins are coupled in parallel at regular intervals to an outer surface of a tube through which a heat medium flows, end plates are coupled to both ends of the tube to which the plurality of heat transfer fins are coupled, and flow path caps are coupled to a front side and a rear side of each of the end plates to change a flow path of the heat medium flowing inside the tube. Such a fin-tube type heat exchanger is disclosed in Korean Registered Patent Nos. 10-1400833 and 10-1086917.

However, the conventional fin-tube type heat exchanger has a problem in that the number of parts is excessive and a connection portion between the parts is coupled by welding such that a coupling structure of the conventional fin-tube type heat exchanger and a manufacturing process thereof are complicated.

Further, since the conventional heat exchanger is configured such that a heat medium flows from one side to the other side of an interior of a tube and each of the tubes has a structure in which a fluid is allowed to communicate between the tubes at only both ends of each of the tubes, a flow path of the heat medium is limited to a distance corresponding to a length of each of the tubes such that a sufficiently long flow path of the heat medium undergoing heat exchange with a combustion gas cannot be secured, and there is a limitation in improving heat exchange efficiency.

Meanwhile, as a configuration for forming a long flow path of a heat medium, the conventional heat exchanger is configured such that a flow direction of the heat medium is changed at a flow path cap provided at both ends of a tube installed inside the conventional heat exchange, and in a section in which the flow direction of the heat medium is changed as described above, a flow velocity of the heat medium is slowed such that a boiling phenomenon of the heat medium, which is heated by combustion heat generated in a combustion chamber, may occur and cause problems in that thermal efficiency is deteriorated and noise is generated.

Further, the conventional heat exchanger may usually be made of steel, and a combustion chamber case assembled to an outer side surface of the conventional heat exchanger may be made of a steel material which is coated with an aluminum layer and is less expensive than steel, and in this case, there is a problem in that corrosion of the combustion chamber case occurs due to a potential difference between the different kinds of metals such that durability of a boiler is lowered and a lifetime thereof is shortened.

DISCLOSURE

Technical Problem

The present invention has been made in order to resolve the above-described problems, and it is an objective of the present invention to provide a round plate heat exchanger having a long flow path of a heat medium formed in an inner space between a plurality of stacked plates and promoting generation of turbulence in flows of the heat medium and a combustion gas to improve heat exchange efficiency.

It is another objective of the present invention to provide a round heat exchanger having a simplified assembly structure and improved durability by enhancing coupling strength.

It is still another objective of the present invention to provide a round plate heat exchanger capable of preventing deterioration of thermal efficiency due to a heat medium boiling and preventing corrosion of a metal resulting from a potential difference between the different kinds of metals being in contact with each other.

Technical Solution

To achieve the above-described objectives, a round plate heat exchanger (1) of the present invention includes a heat exchange part (100) in which a heat medium flow path (P1) and a combustion gas flow path (P2) are alternately formed to be adjacent to each other in a space between a plurality of plates, wherein the plurality of plates constituting the heat exchange part (100) are configured with a plurality of unit plates in each of which a first plate and a second plate are stacked, a plurality of heat medium flow paths (P1) are formed to be spaced apart between the first plate and the second plate, a heat medium connection flow path (P1') is formed in some areas of heat medium flow paths (P1-1 and P1-2) which are disposed to be adjacent to each other, and the combustion gas flow path (P2) is formed between a second plate of a unit plate disposed at one side among adjacently stacked unit plates and a first plate of a unit plate disposed at the other side.

A first convex portion (111) protruding toward the combustion gas flow path (P2) disposed at the one side and a first supporter (112) protruding toward the heat medium flow path (P1) may be alternately formed at the first plate along a flow direction of a combustion gas; and a second convex portion (121) protruding toward the combustion gas flow path (P2) disposed at the other side and a second supporter (122) protruding toward the heat medium flow path (P1) and having an distal end in contact with the first supporter (112) may be alternately formed at the second plate along the flow direction of the combustion gas.

A plurality of first flow path connectors (113) may be formed at the first supporter (112) and spaced apart at predetermined intervals along a length direction of the first supporter (112), and a plurality of second flow path connectors (123) may be formed at positions corresponding to the plurality of first flow path connectors (113) at the second supporter (122) and are spaced apart at predetermined intervals along a length direction of the second supporter (122) such that the heat medium connection flow paths (P1') may be formed between the plurality of first flow path connectors (113) and the plurality of second flow path connectors (123).

A plurality of first turbulence forming portions (114) may be formed at the first convex portion (111) to protrude toward the heat medium flow path (P1) and be spaced apart at predetermined intervals along a length direction of the first convex portion (111), and a plurality of second turbulence forming portions (124) may be formed at the second convex portion (121) to protrude toward the heat medium flow path (P1) and be spaced apart at predetermined intervals along a length direction of the second convex portion (121) between the plurality of first turbulence forming portions (114).

The first convex portion (111) formed at the first plate of the unit plate disposed at the one side among the adjacently stacked unit plates and the second supporter (122) formed at the second plate of the unit plate disposed at the other side may be disposed at positions facing each other and spaced apart from each other, and the first supporter (112) formed at the first plate of the unit plate disposed at the one side and the second convex portion (121) formed at the second plate of the unit plate disposed at the other side may be disposed at positions facing each other and spaced apart from each other.

Also, the adjacently stacked unit plates may be disposed to form a vertical height difference (Δh) therebetween to allow the first convex portion (111) of the first plate and the second supporter (122) of the second plate to be disposed to face each other and allow the first supporter (112) of the first plate and the second convex portion (121) of the second plate to be disposed to face each other.

As one example, a flow path of a heat medium passing through the heat medium flow path (P1) may be formed at the plurality of stacked unit plates in a series structure, and a flow direction of the heat medium in the unit plate disposed at the one side and a flow direction of the heat medium at the unit plate disposed at the other side may be alternately formed to oppose each other.

As another example, a flow path of a heat medium passing through the heat medium flow path (P1) may be formed at the plurality of stacked unit plates in a series-parallel mixed structure, and a flow direction of the heat medium in the plurality of unit plates disposed at the one side and a flow direction of the heat medium in a plurality of unit plates disposed to be adjacent to the plurality of unit plates disposed at the one side may be alternately formed to oppose each other.

A boiling prevention cover (130) may be provided at circumferences of both of the end portions of each of the plurality of plates to prevent a boiling phenomenon of the heat medium which is caused by local overheating due to retention of the heat medium.

A combustion chamber case made of a metal material different from metal materials of the plates constituting the heat exchange part (100) may be coupled to an outer side surface of the heat exchange part (100), and an insulating packing (140) may be provided between the heat exchange part (100) and the combustion chamber case to prevent corrosion of the combustion chamber case due to a potential difference between the different kinds of metals.

Through-holes (H1, H2, H3, and H4) and blocked portions (H1', H2', H3', and H4') may be selectively formed at both end portions of each of the first plate and the second plate to form the flow path of the heat medium passing through the heat medium flow path (P1).

Also, a first protrusion (D1) and a second protrusion (D2) may be formed at both end portions of the first plate of the unit plate disposed at the one side among the adjacently stacked unit plates to protrude toward the combustion gas flow path (P2), and a third protrusion (D3) and a fourth protrusion (D4) may be formed at both end portions of the second plate of the unit plate disposed at the other side to protrude toward the combustion gas flow path (P2) and be respectively in contact with the first protrusion (D1) and the second protrusion (D2) such that combustion gas flow paths (P2) may be formed at constant intervals.

Advantageous Effects

In accordance with the present invention, a plurality of heat medium flow paths are formed to be spaced apart from each other between a first plate and a second plate of each of a plurality of stacked unit plates, and a heat medium connection flow path is formed in some areas of adjacently disposed heat medium flow paths such that a long flow distance of a heat medium undergoing heat exchange with a combustion gas can be formed and heat exchange efficiency can be improved.

Further, a first turbulence forming portion is formed at a first convex portion of the first plate and a second turbulence forming portion is formed at a second convex portion of the second plate and is disposed between first turbulence flow forming portions such that generation of turbulence can be promoted in flows of the heat medium and the combustion gas and the heat exchange efficiency can be further improved.

Furthermore, a first supporter of the first plate and a second supporter of the second plate are configured to be in contact with each other, and surfaces of the first supporter and the second supporter in contact with each other are coupled by welding such that pressure resistance performance of the heat exchanger can be improved.

Moreover, first and second protrusions protruding toward a combustion gas flow path are formed at both end portions of a first plate of a unit plate disposed at one side among adjacently stacked unit plates and third and fourth protrusions protruding toward the combustion gas flow path and in contact with the first and second protrusions, respectively, are formed at both end portions of a unit plate disposed at the other side among the adjacently stacked unit plates such that combustion gas flow paths can be formed at constant intervals, and an assembled state of the heat exchanger can be firmly maintained.

In addition, the adjacently stacked unit plates are disposed to form a vertical height difference between the adjacently stacked unit plates such that condensation due to a capillary action can be prevented at a lower end of the combustion gas flow path and a condensate can be smoothly discharged.

Additionally, a boiling prevention cover is provided at a circumference of each of both end portions of the unit plate at which a flow direction of the heat medium is changed and a flow velocity thereof is slowed such that a boiling phenomenon due to local overheating of the heat medium can be prevented and thermal efficiency can be improved.

Furthermore, an insulating packing is provided between a heat exchange part and a combustion chamber case such that corrosion of the combustion chamber case due to a potential difference between the different kinds of metals being in contact with each other can be effectively prevented.

DESCRIPTION OF DRAWINGS

FIG. 1 is a perspective view of a round plate heat exchanger according to the present invention;

FIG. 2 is a perspective view illustrating a state in which a heat exchange part, a boiling prevention cover, and an insulating packing are separated from the round plate heat exchanger shown in FIG. 1.

FIG. 3 is a plan view of the heat exchange part.

FIG. 4 is a front view of the heat exchange part.

FIG. 5 is a left side view of the heat exchange part.

FIG. 6 is an exploded perspective view of unit plates constituting the heat exchange part.

FIG. 7 is an enlarged perspective view of a portion of the unit plate.

FIG. 8 is a perspective view taken along line A-A of FIG. 3.

FIG. 9 is a perspective view taken along line B-B of FIG. 3.

FIG. 10 is respectively a cross-sectional view and a partially incised perspective view which are taken along line C-C of FIG. 4.

FIG. 11 is respectively a front view and an incised perspective view taken along line F-F in a state in which a second unit plate and a third unit plate are stacked.

FIG. 12 is respectively a cross-sectional view and a partially incised perspective view which are taken along line D-D of FIG. 4.

FIG. 13 is a cross-sectional view taken along line E-E of FIG. 5.

FIG. 14 is a cross-sectional view illustrating a modified embodiment of the heat exchange part.

Description of Reference Numerals

| | |
|---|---|
| 1: round plate heat exchanger | 100: heat exchange unit |
| 101: heat medium inlet | 102: heat medium outlet |
| 100-1 to 100-12: unit plates | 100a-1 to 100a-12: first plates |
| 100b-1 to 100b-14: second plates | 111: first convex portion |
| 112: first supporter | 113: first flow path connector |
| 114: first turbulence forming portion | 115: first flange |
| 121: second convex portion | 122: second supporter |
| 123: second flow path connector | |
| 124: second turbulence forming portion | |
| 125: second flange | 130: boiling prevention cover |
| 140: insulating packing | D1, D2, D3, and D4: protrusions |
| H1, H2, H3, and H4: through-holes | |
| H1', H2', H3', and H4': blocked portions | |
| P1: heat medium flow path | |
| P1-1: upper side heat medium flow path | |
| P1-2: lower side heat medium flow path | |
| P1': heat medium connection flow path | |
| P2: combustion gas flow path | |

MODES OF THE INVENTION

Hereinafter, configurations and operations for preferred embodiments of the present disclosure will be described in detail with reference to the accompanying drawings.

Referring to FIGS. 1 to 7, a round plate heat exchanger 1 according to the present invention includes a heat exchange part 100 constituted by stacking a plurality of plates. Further, a boiling prevention cover 130 may surround both sides of the heat exchange part 100, and an insulating packing 140 may be attached to an outer side surface of the boiling prevention cover 130 and front and rear surfaces of the heat exchange part 100.

Hereinafter, a configuration and operation of the heat exchange part 100 will be described first, and configurations and operation of the boiling prevention cover 130 and the insulating packing 140 will be described below.

In a space between the plurality of plates constituting the heat exchange part 100, a heat medium flow path P1 through which a heat medium flows and a combustion gas flow path P2 through which a combustion gas generated by combustion in a burner (not shown) flows are alternately formed to be adjacent to each other as shown in FIG. 10. The heat medium may be heating water, hot water, or other fluids.

As one example, the plurality of plates may be configured with first to twelfth unit plates 100-1, 100-2, 100-3, 100-4, 100-5, 100-6, 100-7, 100-8, 100-9, 100-10, 100-11, and 100-12, and the unit plates may be configured with first plates 100*a*-1, 100*a*-2, 100*a*-3, 100*a*-4, 100*a*-5, 100*a*-6, 100*a*-7, 100*a*-8, 100*a*-9, 100*a*-10, 100*a*-11, and 100*a*-12, which are disposed at front sides of the unit plates, and second plates 100*b*-1, 100*b*-2, 100*b*-3, 100*b*-4, 100*b*-5, 100*b*-6, 100*b*-7, 100*b*-8, 100*b*-9, 100*b*-10, 100*b*-11, and 100*b*-12, which are disposed at back sides of the unit plates, as shown in FIG. 6. However, the number of the plurality of plates may be differently configured from the present embodiment according to a capacity of the heat exchange part.

Referring to FIGS. 6, 7, and 10 to 12, a plurality of heat medium flow paths P1 are formed in a space between the first plate and the second plate constituting each of the plurality of unit plates. A heat medium connection flow path P1' is formed at some areas of adjacently disposed heat medium flow paths P1-1 and P1-2 to provide a flow path in which a heat medium is mixed to flow between the heat medium flow path P1-1 disposed at an upper side and the heat medium flow path P1-2 disposed at a lower side.

The combustion gas flow path P2 is formed in a space between a second plate of a unit plate disposed at one side and a first plate of a unit plate disposed to be adjacent to the unit plate disposed at the one side.

The first plate is configured such that a first convex portion 111 protruding toward the combustion gas flow path P2 located at one side and a first supporter 112 protruding toward the heat medium flow path P1 are alternately formed along a flow direction of the combustion gas.

The second plate is formed in a shape substantially symmetrical to the first plate and is configured such that a second convex portion 121 protruding toward the combustion gas flow path P2 disposed at the other side and a second supporter 122 protruding toward the heat medium flow path P1 are alternately formed along the flow direction of the combustion gas.

A protruding end of the first supporter 112 of the first plate and a protruding end of the second supporter 122 of the second plate are disposed to be in contact with each other, and surfaces at which the first supporter 112 and the second supporter 122 are in contact may be coupled by welding. According to such a configuration, the separated heat medium flow paths P1 (P1-1 and P1-2) are formed and spaced apart at the upper and lower sides on the basis of the surfaces at which the first supporter 112 and the second supporter 122 are in contact with each other, and the first plate and the second plate are firmly coupled such that pressure resistance performance of the heat exchanger can be improved.

A plurality of first flow path connectors 113 are formed at the first supporter 112 of the first plate and are spaced apart at predetermined intervals along a length direction of the first supporter 112 of the first plate, and a plurality of second flow path connectors 123 are formed at positions corresponding to the plurality of first flow path connectors 113 on the second supporter 122 of the second plate and are spaced apart at predetermined intervals along a length direction of the second supporter 122 of the second plate such that heat medium connection flow paths P1' are formed between the plurality of first flow path connectors 113 and the plurality of second flow path connectors 123.

As described above, the heat medium connection flow paths P1' are formed to connect the plurality of heat medium flow paths P1-1 and P1-2, which are formed and vertically spaced apart, and thus, as shown in FIG. 11, the heat medium flows and passes through the heat medium flow path P1-1 disposed at the upper side and the heat medium flow path P1-2 disposed at the lower side at the same time that some of the heat medium flows via a space between the plurality of heat medium flow paths P1-1 and P1-2 which are vertically disposed such that a long flow path of the heat medium can be formed and the heat medium passing through the heat medium flow paths P1-1 and P1-2 can also be mixed to promote generation of turbulence, thereby significantly improving heat exchange efficiency.

A plurality of first turbulence forming portions 114 protruding toward the heat medium flow path P1 are formed at the first convex portion 111 and are spaced apart at predetermined intervals along a length direction of the first convex portion 111, and a plurality of second turbulence forming portions 124 protruding toward the heat medium flow path P1 and disposed between the plurality of first turbulence forming portions 114 are formed at the second convex portion 121 and are spaced apart at predetermined intervals along a length direction of the second convex portion 121.

According to the configurations of the first turbulence forming portions 114 and the second turbulence forming portions 124, generation of turbulence is promoted in flows of the heat medium and the combustion gas such that the heat exchange efficiency can be further improved.

Meanwhile, the first convex portion 111 formed at a first plate of a unit plate disposed at one side among the adjacently stacked unit plates and the second supporter 122 formed at a second plate of a unit plate disposed at the other side may be configured to be formed at positions facing each other and spaced apart from each other, and the first supporter 112 formed at the first plate of the unit plate disposed at the one side and the second convex portion 121 formed at the second plate of the unit plate disposed at the other side may be configured to be disposed at positions facing each other and spaced apart from each other.

Referring to FIG. 5, the adjacently stacked unit plates are disposed to form a vertical height difference Δh between a height h1 of a unit plate disposed at one side among the adjacently stacked unit plates and a height h2 of a unit plate disposed to be adjacent to the unit plate disposed at the one side such that the first convex portion 111 of the first plate is disposed to face the second supporter 122 of the second plate and the first supporter 112 of the first plate is disposed to face the second convex portion 121 of the second plate.

Therefore, as shown in FIGS. 6 and 10, the first plate and the second plate are formed in predetermined shapes, and adjacent unit plates are disposed to have different heights such that the combustion gas flow path P2 can be configured to be curved in an approximate "S" shape.

Accordingly, generation of turbulence is promoted in the flow of the combustion gas passing through the combustion gas flow path P2 along a direction of a dotted line arrow in FIG. 5 such that heat exchange efficiency between the combustion gas and the heat medium can be improved.

Further, the adjacent unit plates are disposed to form the vertical height difference Δh between the adjacent unit plates such that condensation due to a capillary action can be prevented at a lower end of the combustion gas flow path P2 and a condensate can be smoothly discharged. When unit plates are adjacently disposed at the same height, there is a problem in that water vapor contained in a combustion gas, which is cooled while passing through the combustion gas flow path P2, is condensed such that a condensate is formed between a second plate of a unit plate disposed at one side among the adjacently disposed unit plates and a first plate of a unit plate disposed at the other side, wherein the second plate and the first plate are disposed in parallel at the lower end of the combustion gas flow path P2 at a narrow interval.

On the contrary, when the unit plates are adjacently disposed to form the vertical height difference Δh between the adjacently disposed unit plates as in the present invention, a distance between the second plate of the unit plate disposed at the one side and the first plate of the unit plate disposed at the other side is widened and the second plate and the first plate are disposed at the lower end of the combustion gas flow path P2 such that the capillary action can be prevented and the condensate can be smoothly discharged.

Meanwhile, a first flange 115 is formed at a rim of the first plate, and a second flange 125 is formed at a rim of the second plate in a shape in contact with the first flange 115 to seal the heat medium flow path P1.

Referring to FIG. 7, a first protrusion D1 and a second protrusion D2 protruding toward the combustion gas flow path P2 are formed at both end portions of the first plate of a unit plate disposed at one side among the adjacently stacked unit plates, and a third protrusion D3 and a fourth protrusion D4, which protrude toward the combustion gas flow path P2 and are respectively in contact with the first protrusion D1 and the second protrusion D2, are formed at both sides of a second plate of a unit plate disposed at the other side such that the combustion gas flow paths P2 can be formed at constant intervals and coupling strength between the plurality of unit plates can be enhanced.

Further, through-holes H1, H2, H3, and H4 and blocked portions H1', H2', H3', and H4' may be selectively formed at both sides of each of the first plate and the second plate to provide a flow path of the heat medium passing through the heat medium flow path P1.

In one example, as shown in FIG. 6, a heat medium flowing into the heat medium flow path P1 of the first unit plate 100-1 through the heat medium inlet 101 formed at one side of the first plate **100*a*-1 of the first unit plate 100-1 is blocked by the blocked portion H4' formed at one side of the second plate 100*b*-1 to be guided to one side of the heat medium flow path P1, and the heat medium passes through the through-hole H3 formed at the other side of the second plate 100*b*-1 and the through-hole H1 formed at one side of the first plate 100*a*-2 of the second unit plate 100-2 disposed behind the second plate 100*b*-1 to flow into the heat medium flow path P1 of the second unit plate 100-2**.

The heat medium flowing into the heat medium flow path P1 of the second unit plate 100-2 is blocked by the blocked portion H3' formed at one side of the second plate **100*b*-2 to be guided to one side of the heat medium flow path P1, and then the heat medium passes through the through-hole H4** formed at the other side of the second plate 100*b*-2 and the through-hole H2 formed at one side of the first plate 100*a*-3 of the third unit plate 100-3 disposed behind the second plate 100*b*-2 to flow into the heat medium flow path P1 of the third unit plate 100-3.

As described above, the flow direction of the heat medium is alternately changed toward the one side and the other side and the heat medium sequentially passes through the heat medium outlet 102 formed at the unit plate 100-12 disposed at the rearmost position to be discharged. With such a configuration, the heat medium flows as indicated by solid arrows in FIG. 13.

In this embodiment, the heat medium flow path P1 is formed in a serial structure and is configured such that the flow direction of the heat medium in the unit plate disposed at the one side is opposite the flow direction of the heat medium in the unit plate disposed at the other side.

In another embodiment, as shown in FIG. 14, the heat medium flow path P1 may be formed in a series-parallel mixed structure, and alternatively, the heat medium flow path P1 may be configured such that the flow direction of the heat medium in the plurality of unit plates disposed at the one side and the flow direction of the heat medium in the plurality of unit plates stacked adjacent to the plurality of unit plates may be alternately opposed.

As described above, the flow path of the heat medium may be variously modified and implemented by changing formation positions of the through-holes H1, H2, H3, and H4 and the blocked portions H1', H2', H3', and H4' which are formed at the first plate and the second plate.

Accordingly, since the flow direction of the heat medium is changed at both of the sides of the heat exchange part 100 to allow the heat medium to flow, the flow of the heat medium is slowed at both of the sides of the heat exchange part 100 such that a boiling phenomenon of the heat medium heated by combustion heat generated in the combustion chamber may occur and cause thermal efficiency deterioration and noise generation.

As a configuration for preventing the boiling phenomenon of the heat medium at both of the sides of the heat exchange part 100, the boiling prevention cover 130 is provided at both of the sides of the heat exchange part 100.

Referring to FIGS. 1 and 2, the boiling prevention cover 130 may include a side surface portion 131, and an upper end portion 132 and a lower end portion 133 extending by a predetermined distance from upper and lower ends of the side surface portion 131 toward the heat exchange part 100, and the boiling prevention cover 130 may be made of the same stainless steel (SUS) as materials of the plates constituting the heat exchange part 100.

Further, a combustion chamber case (not shown) may be coupled to an outer side surface of the heat exchange part 100 and be made of a steel material coated with an aluminum layer. In this case, since the plates of the heat exchange part 100, the boiling prevention cover 130, and the combustion chamber case are made of different materials, corrosion of the combustion chamber case may occur due to a potential difference between the different kinds of metals being contact with each other.

As a configuration for preventing the corrosion, the insulating packing 140 made of a ceramic or an inorganic material is provided at an outer side surface of the boiling prevention cover 130 and front and rear surfaces of the heat exchange part 100 to prevent a potential difference between the combustion chamber case, the boiling prevention cover 130, and the heat exchange part 100.

According to such a configuration, the combustion chamber case is made of a steel material coated with an aluminum layer, which is relatively inexpensive when compared with the stainless steel material, so that a manufacturing cost of the boiler can be reduced while effectively preventing corrosion of the combustion chamber case to enhance durability of the boiler.

The invention claimed is:

1. A round plate heat exchanger comprising:

a heat exchange part (100) having a plurality of heat medium flow paths (P1) extending in a flow direction of a heat medium and aligned parallel to each other in a height direction, a plurality of combustion gas flow paths (P2), a plurality of heat medium connection flow paths (P1'), and a plurality of unit plates stacked parallel to each other in a stack direction, wherein, the flow direction of the heat medium, the height direction, and the stack direction are perpendicular to one another, each of the plurality of unit plates comprises a first plate and a second plate, wherein the first plate and the second plate are stacked, each of the plurality of heat medium flow paths (P1) is formed to be spaced apart between the first plate and the second plate of each of the plurality of unit plates, and comprises an upper side heat medium flow path (P1-1) and a lower side heat medium flow path (P1-2), wherein the upper side heat medium flow path (P1-1) and the lower side heat medium flow path (P1-2) are configured such that the heat medium flows in the flow direction of a heat medium separately, each of the plurality of combustion gas flow paths (P2) is formed between the second plate of one unit plate of adjacently stacked unit plates and the first plate of the other unit plate of adjacently stacked unit plates such that each of the plurality of heat medium flow paths (P1) and each of the plurality of combustion gas flow paths (P2) are alternately formed to be adjacent to each other, each of the plurality of heat medium connection flow paths (P1') is connected to the upper side heat medium flow path (P1-1) and the lower side heat medium flow path (P1-2) such that the heat medium flows between the upper side heat medium flow path (P1-1) and the lower side heat medium flow path (P1-2) and the heat medium is mixed, wherein the upper side heat medium flow path (P1-1) and the lower side heat medium flow path (P1-2) are on the same heat medium flow path or on different heat medium flow paths of adjacently stacked heat medium flow paths, and the plurality of unit plates are aligned in an alternating manner along the height direction with a relative displacement ($\Delta h$) along the height direction between the adjacently stacked unit plates.

2. The round plate heat exchanger of claim 1, wherein:

a first convex portion (111) protruding toward each of the plurality of combustion gas flow paths (P2) disposed at the one side and a first supporter (112) protruding toward each of the plurality of heat medium flow paths (P1) are alternately formed at the first plate along a flow direction of a combustion gas, and a second convex portion (121) protruding toward each of the plurality of combustion gas flow paths (P2) disposed at the other side and a second supporter (122) protruding toward each of the plurality of heat medium flow paths (P1) and having a distal end in contact with the first supporter (112) are alternately formed at the second plate along the flow direction of the combustion gas.

3. The round plate heat exchanger of claim 2, wherein a plurality of first flow path connectors (113) are formed at the first supporter (112) and spaced apart at predetermined intervals along a length direction of the first supporter (112), and a plurality of second flow path connectors (123) are formed at positions corresponding to the plurality of first flow path connectors (113) at the second supporter (122) and are spaced apart at predetermined intervals along a length direction of the second supporter (122) such that each of the plurality of heat medium connection flow paths (P1') is formed between each of the plurality of first flow path connectors (113) and each of the plurality of second flow path connectors (123).

4. The round plate heat exchanger of claim 2, wherein a plurality of first turbulence forming portions (114) are each formed at the first convex portion (111) to protrude toward each of the plurality of heat medium flow paths (P1) and be spaced apart at predetermined intervals along a length direction of the first convex portion (111), and a plurality of second turbulence forming portions (124) are each formed at the second convex portion (121) to protrude toward each of the plurality of heat medium flow paths (P1) and be spaced apart at predetermined intervals along a length direction of the second convex portion (121) between the plurality of first turbulence forming portions (114).

5. The round plate heat exchanger of claim 2, wherein:

the first convex portion (111) formed at the first plate of each of the plurality of unit plates disposed at the one side among the adjacently stacked unit plates and the second supporter (122) formed at the second plate of each of the plurality of unit plates disposed at the other side are disposed at positions facing each other and spaced apart from each other, and the first supporter (112) formed at the first plate of each of the plurality of unit plates disposed at the one side and the second convex portion (121) formed at the second plate of each of the plurality of unit plates disposed at the other side are disposed at positions facing each other and spaced apart from each other.

6. The round plate heat exchanger of claim 1, wherein:

a flow path of a heat medium passing through each of the plurality of heat medium flow paths (P1) is formed at the plurality of unit plates stacked in a series structure, and the flow direction of the heat medium in each of the plurality of unit plates disposed at the one side and the flow direction of the heat medium at each of the plurality of unit plates disposed at the other side are alternately formed to oppose each other.

7. The round plate heat exchanger of claim 1, wherein:

a flow path of a heat medium passing through the heat medium flow path (P1) is formed at the plurality of stacked unit plates in a series-parallel mixed structure, and a flow direction of the heat medium in the plurality of unit plates disposed at the one side and a flow direction of the heat medium in a plurality of unit plates disposed to be adjacent to the plurality of unit plates disposed at the one side are alternately formed to oppose each other.

8. The round plate heat exchanger of claim 6, wherein a boiling prevention cover (130) is provided at circumferences of both of the sides of each of the plurality of plates to prevent a boiling phenomenon of the heat medium which is caused by local overheating due to retention of the heat medium.

9. The round plate heat exchanger of claim 8, wherein:

an insulating packing (140) is provided at an outer side surface of the boiling prevention cover (130) and front and rear surfaces of the heat exchange part (100).

10. The round plate heat exchanger of claim 6, wherein through-holes (H1, H2, H3, and H4) and blocked portions (H1', H2', H3', and H4') are formed at both sides of each of the first plate and the second plate and locations of the through-holes (H1, H2, H3, and H4) and the blocked portions (H1', H2', H3', and H4') determine the flow path of the heat medium.

11. The round plate heat exchanger of claim 1, wherein a first protrusion (D1) and a second protrusion (D2) are formed at both sides of the first plate of the unit plate disposed at the one side among the adjacently stacked unit plates to protrude toward the combustion gas flow path (P2), and a third protrusion (D3) and a fourth protrusion (D4) are formed at both sides of the second plate of the unit plate disposed at the other side to protrude toward the combustion gas flow path (P2) and be respectively in contact with the first protrusion (D1) and the second protrusion (D2) such that combustion gas flow paths (P2) are formed at constant intervals.

12. The round plate heat exchanger of claim 7, wherein a boiling prevention cover (130) is provided at circumferences of both of the sides of each of the plurality of plates to prevent a boiling phenomenon of the heat medium which is caused by local overheating due to retention of the heat medium.

13. The round plate heat exchanger of claim 7, wherein:

a combustion chamber case made of a metal material different from metal materials of the plates constituting the heat exchange part (100) is coupled to an outer side surface of the heat exchange part (100), and an insulating packing (140) is provided between the heat exchange part (100) and the combustion chamber case to prevent corrosion of the combustion chamber case due to a potential difference between the different kinds of metals.

14. The round plate heat exchanger of claim 7, wherein through-holes (H1, H2, H3, and H4) and blocked portions (H1', H2', H3', and H4') are selectively formed at both sides of each of the first plate and the second plate to form the flow path of the heat medium passing through the heat medium flow path (P1).

* * * * *